US005460149A

United States Patent [19]

Tofel et al.

[11] Patent Number: 5,460,149

[45] Date of Patent: Oct. 24, 1995

[54] CARBURETOR KIT FOR IMPROVED AIR-FUEL MIXTURE

[76] Inventors: Richard M. Tofel, 6221 N. Cadena De Montanas, Tucson, Ariz. 85718; Jon A. Petty, 2767-B W. Anklam, Tucson, Ariz. 85745

[21] Appl. No.: 240,233

[22] Filed: May 10, 1994

Related U.S. Application Data

[63] Continuation-in-part of Ser. No. 82,487, Jun. 28, 1993, Pat. No. 5,309,889, which is a continuation-in-part of Ser. No. 16,047, Feb. 10, 1993, Pat. No. 5,299,551.

[51] Int. Cl.[6] ..... F02D 41/14

[52] U.S. Cl. ..... 123/676; 123/700; 123/701

[58] Field of Search ..... 123/437, 438, 123/676, 700, 701

[56] References Cited

U.S. PATENT DOCUMENTS

| | | | |
|---|---|---|---|
| 3,730,157 | 5/1973 | Gerhold | 123/437 |
| 3,742,924 | 7/1973 | Bachle | 123/676 |
| 3,921,612 | 11/1975 | Aono | 123/438 |
| 4,034,727 | 7/1977 | Aono et al. | 123/701 |
| 4,034,730 | 7/1977 | Ayers et al. | 123/701 |
| 4,052,968 | 10/1977 | Hattori et al. | 123/700 X |
| 4,119,074 | 10/1978 | Masaki et al. | 123/700 X |
| 4,191,149 | 3/1980 | Dutta et al. | 123/701 |
| 4,363,209 | 12/1982 | Atago et al. | 60/274 |
| 4,512,304 | 4/1985 | Snyder | 123/344 |

*Primary Examiner*—Tony M. Argenbright
*Attorney, Agent, or Firm*—Antonio R. Durando

[57] ABSTRACT

Flow passage lines are used to connect the float chamber of a conventional carburetor both to the engine's intake and exhaust manifold. The gas flow produced by the exhaust manifold provides a continuous source of positive pressure to the float chamber, while the engine's suction and the corresponding vacuum in the intake manifold provide a continuous source of negative pressure. The flow rates in the positive pressure line and in the negative pressure line are regulated by means of two control solenoid valves. The pressure in the float chamber reflects the net impact of the positive and negative pressures transmitted trough the lines. The solenoid valves are responsive to a control signal generated by an electronic circuit as a function of deviations in the oxygen content of the exhaust gases from a desired set point. The ambient pressure in the float chamber is either increased or decreased as the oxygen sensor indicates that either a lean or a rich fuel mixture is being combusted in the engine. A third solenoid valve in series in the negative pressure line and an accumulator chamber are also used to provide fine control to the vacuum from the intake manifold. Finally, a bypass air bleed may be used to increase the air/fuel ratio at idle.

24 Claims, 10 Drawing Sheets

CARBURETOR KIT FOR IMPROVED AIR-FUEL MIXTURE

RELATED APPLICATIONS

This application is a continuation-in-part of Ser. No. 08/082,487, filed Jun. 28, 1993, now U.S. Pat. No. 5,309,889, which is a continuation-in-part of Ser. No. 08/016,047, filed Feb. 10, 1993, issued on Apr. 5, 1994, as U.S. Pat. No. 5,299,551.

BACKGROUND OF THE INVENTION

1. Field of the Invention

This invention is related in general to carburetors for internal-combustion engines that comprise a feedback control system responsive to the composition of the engine exhaust gases. In particular, this invention provides a new device for improving the air-fuel mixture supplied to the engine by controlling the pressure in the float chamber of the carburetor.

2. Description of the Related Art

As is well understood in the art, conventional internal-combustion engines are fueled with an air-fuel mixture that is formed in the carburetor and passed to the intake manifold of the engine. Referring to the schematic representation of FIG. 1, ambient air is drawn by the engine suction into the intake manifold 2 through a venturi tube 4 contained within the body of the carburetor 6. The flow of air is controlled by the position of a throttle 8, which normally consists of a butterfly valve operated by a user by means of a remote linkage system. When the valve is closed and the engine is idling, little air passes through the venturi tube, so that little or no fuel is drawn into the air stream by the venturi effect in tube 4; the fuel is instead drawn by the engine's suction directly from the float chamber or bowl 10 into the manifold 2 through an idle bypass circuit 12. As the throttle valve is opened and more air is allowed to pass through the venturi tube, the decrease in static pressure created by the restriction in the tube causes a pressure differential that results in fuel being delivered to the air stream within the venturi tube itself through a main jet system 14. As the throttle is further opened and the engine's speed (rpm) increases, more air is drawn causing a yet lower static pressure within the venturi tube and greater fuel flow rate into the air stream.

In order to optimize fuel efficiency and pollution control, the air-fuel ratio in the mixture flowing to the engine should at all times be equal to the stoichiometric ratio required for full combustion. This is impossible to achieve with a system that relies on a number of fixed-size jets to meter the fuel flow to the intake manifold. Therefore, in designing a carburetor, the dimensions of the jets in the idle bypass circuit 12 and in the main jet system 14 are chosen to provide air-fuel ratios corresponding to optimal overall performance within the range of operation of the engine. Typically, the mixture is richer than the stoichiometric requirement (that is, it contains more fuel than necessary for complete combustion) at idle speeds and it becomes progressively leaner at higher speeds. The resulting effect is that the air-fuel ratio is sub-optimal nearly at all times. Thus, additional methods of controlling the air-fuel ratio are required for optimal performance.

From the foregoing and from basic principles of fluid dynamics it becomes apparent that the pressure in the float chamber of a conventional internal-combustion engine carburetor affects the air-fuel mixture delivered to the engine.

In conventional carburetors, the float chamber is kept at substantially atmospheric pressure by means of a vent typically connecting the chamber to a region downstream of the air filter. As a result, the air-fuel ratio is determined only by the pressure in the venturi tube (or manifold, at idle speed) and by the metering of the various jets in the carburetor as fuel is drawn from the float chamber by the suction created in the main venturi tube. By varying the pressure in the float chamber, an additional control variable is available that can be used to regulate the air-fuel ratio to the engine. Several patents have described devices that utilize this principle in a feedback control loop system for optimizing the composition of the air-fuel mixture at all times during operation. Typically, these systems measure the oxygen content in the engine's exhaust and utilize it as a measure of the deviation of the air-fuel ratio from the optimal mixture. This information is then used to generate a control signal for varying the pressure in the float chamber. If the exhaust's oxygen content indicates that the mixture is too rich, the pressure is decreased, resulting in a reduced flow rate of fuel to the venturi tube and, accordingly, a leaner mixture. The opposite control action is produced, of course, when the mixture is too lean.

For example, U.S. Pat. No. 3,742,924 issued to Bachle (1973) describes a device for providing variable ambient pressure in the float chamber of a carburetor. The pressure variations are produced by a valve installed in a tube connecting the chamber to the venturi of the carburetor, so that a vacuum (and a leaner mixture) is obtained when the valve is open. The control of the valve is effected by a solenoid driven by the signal generated by a sensor in the exhaust pipe of the engine.

In U.S. Pat. No. 4,034,727 (1977), Aono et al. describe a similar device where the pressure variation in the float chamber is produced by a vibrating diaphragm built into the vapor side of the chamber. The diaphragm is driven by an electromagnetic transducer, which is itself controlled by a signal designed to optimize the fuel mixture under varying operating conditions.

U.S. Pat. No. 4,034,730 to Ayres et al. (1977) discloses a carburetor where the pressure of the fuel in the float chamber is determined by the operation of an electric fuel pump. The pump in turn is controlled by electronic circuitry responsive to a sensor in the exhaust pipe of the system. When the fuel mixture is too lean with respect to a set point for the driving conditions, the pump produces a higher pressure and more fuel is supplied to the venturi. The converse occurs, on the other hand, when the mixture is too rich.

U.S. Pat. No. 4,191,149 to Dutta et al. (1980) shows a carburetor where the pressure in the float chamber is varied by means of a line connected to the restriction of a venturi tube. The tube is coupled to a compressor on one side and to a valve open to the atmosphere on the other, so that the pressure drop across the venturi is affected by the opening of the valve. As the valve is closed, the pressure in the venturi increases, also causing the pressure in the float chamber to increase and produce a richer mixture. A system of orifices in every segment of the system is used to optimize the effect of the valve on the float chamber pressure. In another embodiment of the invention, air is drawn by the vacuum in the exhaust manifold from the outside atmosphere into a venturi tube connected to the float chamber. The air flow is regulated by a valve actuated by a controller responsive to the signal generated by an oxygen sensor in the exhaust stream. When the valve is closed, a vacuum is transmitted to the float chamber; as the valve opens, air is drawn from the outside through the Pitot tube and the pressure in the float chamber increases accordingly.

In U.S. Pat. No. 4,512,304 (1985), Snyder describes a device for regulating the supply of fuel to the engine. Pressure is applied to the regulator to cause a predetermined rate of flow of gasoline to the carburetor, thereby affecting the air to fuel ratio. The pressure exerted is a result of a signal from an exhaust gas sensor.

Finally, U.S. Pat. No. 4,363,209 to Atago et al. (1982) discloses a carburetor system that produces a negative pressure on the fuel jets in order to vary the throughput to the venturi. The negative pressure is obtained by connecting a vacuum source to the jet ducts by means of a valve responsive to a control circuit connected to an exhaust gas sensor.

All of these systems require either modifications to the design of a conventional carburetor or additions of expensive apparatus to standard equipment. Therefore, they are not economically suitable for after-market application. In addition, physical constraints often limit the ability of some devices to perform according to their design specifications. For example, we found that the second embodiment of the invention described in the Dutta et al. patent is not practically feasible for correcting a lean mixture because a very large air intake would be required to generate a positive pressure to the float chamber through a Pitot tube. This air would then flow to the intake manifold and further dilute an already lean mixture, thus aggravating the condition and providing no effective control.

Therefore, there still exists a need for simpler and more effective system for optimizing an engine's air-fuel ratio by varying the pressure in the float chamber of the carburetor. The present invention is directed at apparatus that permits the easy and relatively inexpensive conversion of a conventional carburetor to a feedback-controlled system that effectively varies the air-fuel ratio for optimal operation under all conditions.

BRIEF SUMMARY OF THE INVENTION

It is therefore an object of this invention to provide apparatus in the form of a kit that can be installed on a conventional carburetor system as an after-market product.

It is another object of the invention to provide apparatus that controls the flow of fuel from the float chamber to the air stream of a conventional carburetor by varying the ambient pressure in the float chamber in response to variations in the oxygen content in the exhaust gases from a predetermined set point.

It is yet another goal of the invention to provide both positive and negative pressure controls by utilizing sources available within the standard equipment of an engine, so that the use of an additional compressor or vacuum pump becomes unnecessary.

Still another objective is apparatus that can be calibrated to function effectively on any engine fueled by a conventional carburetor, regardless of size and specific carburetor design.

A final objective of this invention is the realization of the above mentioned goals in an economical and commercially viable manner.

These goals are achieved according to this invention by connecting the float chamber of a conventional carburetor both to the engine's intake manifold and exhaust manifold. The gas flow produced by the exhaust manifold provides a continuous source of positive pressure to the float chamber, while the engine's suction and the corresponding vacuum in the intake manifold provide a continuous source of negative pressure. The flow rates in the positive pressure line and in the negative pressure line are regulated by means of two control solenoid valves. The pressure in the float chamber reflects the net impact of the positive and negative pressures transmitted trough the lines. The solenoid valves are responsive to a control signal generated by an electronic circuit as a function of deviations in the oxygen content of the exhaust gases from a desired set point. The ambient pressure in the float chamber is either increased or decreased as the oxygen sensor indicates that either a lean or a rich fuel mixture is being combusted in the engine. A third solenoid valve in series in the negative pressure line and an accumulator chamber are also used to provide fine control to the vacuum from the intake manifold. Finally, a bypass air bleed may be used to increase the air/fuel ratio at idle.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only some of the various ways in which the invention may be practiced.

DETAILED DESCRIPTION OF THE PREFERRED EMBODIMENT

As illustrated in the devices noted in the prior art, the idea of regulating the air-fuel mixture in a carburetor by controlling the ambient pressure in the float chamber is not new and is well understood. This invention is based on a novel way to provide both the negative and the positive pressure differentials required to implement the concept without installing pressure sources in addition to the equipment found in standard internal-combustion engines. Moreover, the apparatus of the invention can be installed on almost any engine with only minor modifications to the carburetor and exhaust system.

Figure 1:
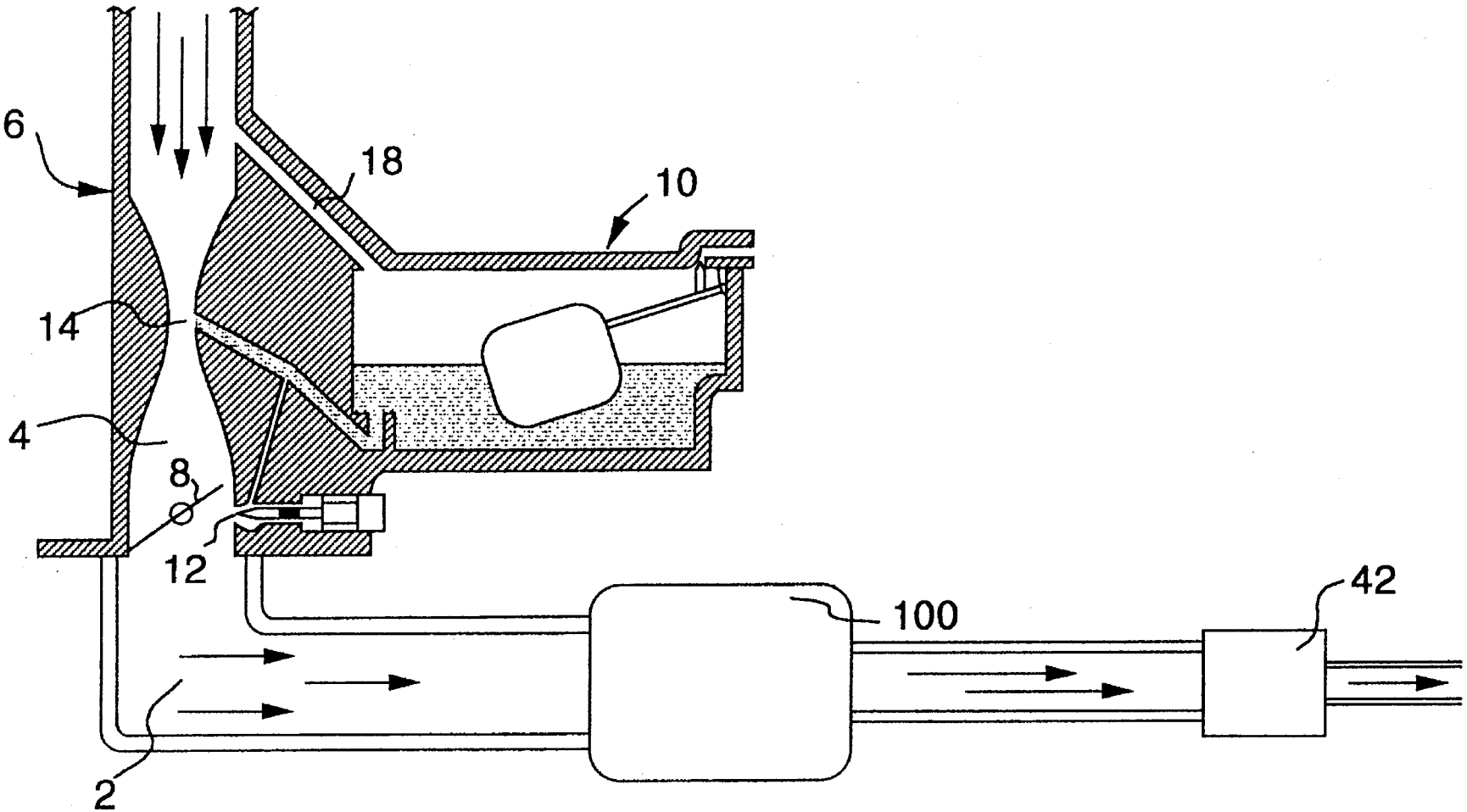
FIG. 1 is a schematic view of an internal-combustion engine fitted with a conventional carburetor.
Figure 2:
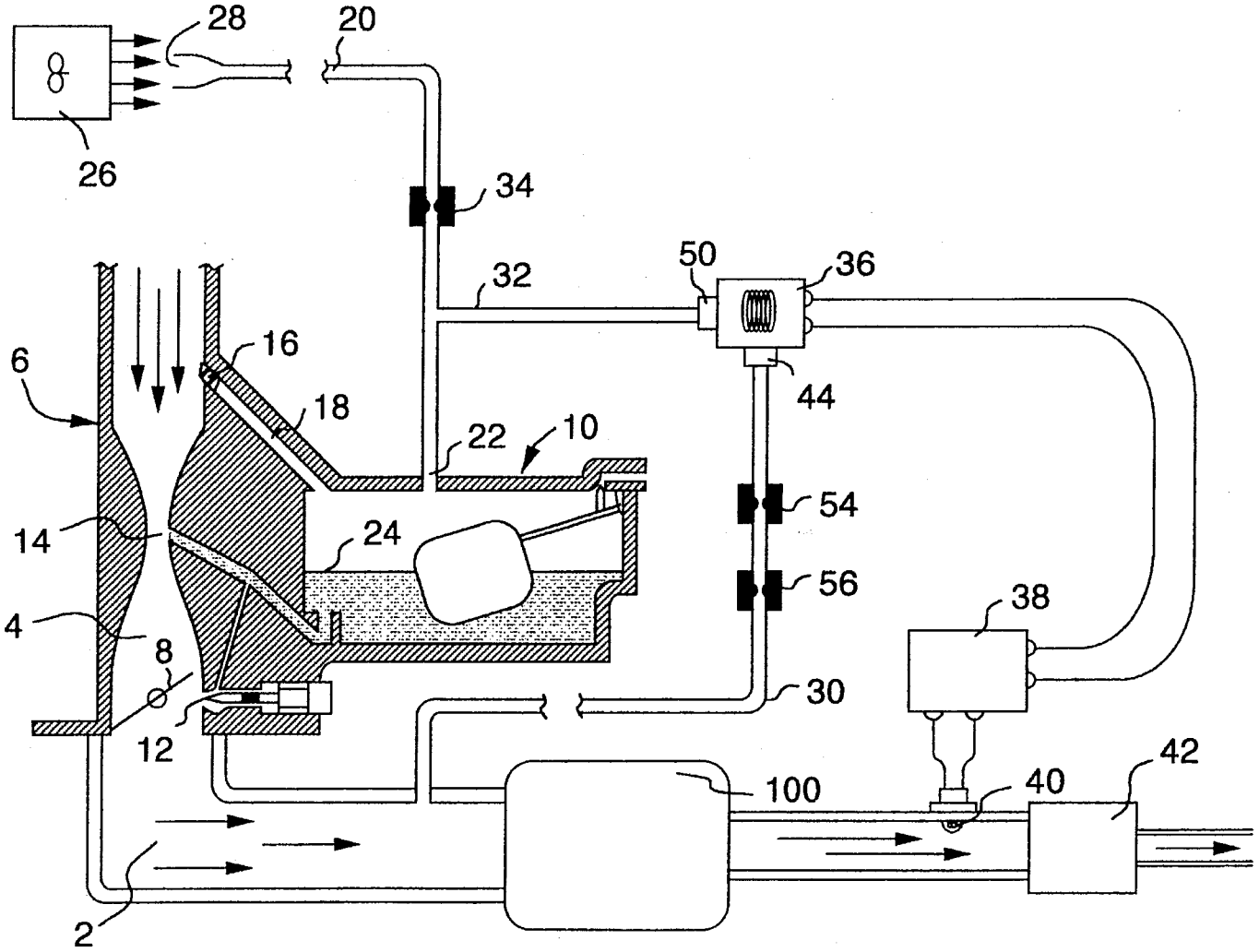
FIG. 2 is a schematic view of an internal-combustion engine carburetor retrofitted with a positive-pressure line and a negative-pressure line pneumatically connected to the engine's radiator fan and intake manifold, respectively, wherein the flow through each line is regulated by a single control valve responsive to the oxygen content in the exhaust gases.

For purposes of explanation, the terms "positive" and "negative" are used herein to refer to pressures above and below the surrounding atmospheric pressure, respectively. Referring to the drawings, wherein like parts are designated throughout with like numerals and symbols, FIG. 2 illustrates in schematic representation an embodiment of the apparatus of the invention installed on an engine 100 fueled through a conventional carburetor 6. A positive pressure line 20 is tapped into the wall of the float chamber 10 at a point 22 above the fuel level 24, so that it is in pneumatic communication with the gaseous phase in the chamber. The line 20 is then extended to a point directly downstream of the engine's radiator fan 26 and the mouth of the end 28 of the line is positioned facing upstream, so that it constitutes a capture tube receiving the full flow of air generated by the fan. Also, the float chamber 10 is isolated from the outside atmosphere by introducing a plug 16 in the atmospheric vent 18 that is always found in conventional carburetors to provide a reference pressure for the operation of the venturi tube. Any means suitable to effect the permanent blockage of the vent 18 is acceptable for this purpose. We found that such a plug can be readily made with a material like a silicone compound, which is insoluble in gasoline and can be easily introduced into the vent 18 and allowed to harden.

Thus, the fuel in the float chamber becomes subjected to a positive pressure differential directly related to the speed of the fan 26 and the draft created thereby. Since the fan speed increases with the engine's speed, the positive pressure differential also increases and provides a higher pressure differential to the venturi tube, in turn resulting in more fuel being delivered to the air stream through the carburetor than would be the case if the float chamber were kept at constant atmospheric pressure. When compared to a standard carburetor having a float chamber vented to atmosphere, this feature tends to increase the incremental flow rate of fuel to the venturi as the engine's rpm increases, which is consistent with the need to balance the tendency of venturi tube operation to produce leaner mixtures at high speeds. Note that, by placing the mouth 28 of the capture tube in the positive pressure line downstream of the radiator fan, this feature is generally retained even for clutch-operated fans that are turned off by a radiator temperature control. That is so because these fans are usually turned off only at high vehicle speeds, when the wind and natural draft generated by the motion of the vehicle suffice to cool the radiator; therefore, the same draft is available to the positive pressure line 20 of the present invention. As the engine's rpm is reduced, the fan speed is correspondingly reduced and the positive pressure provided to the chamber becomes smaller. At the limit, when the fan stops, the line 20 connects the chamber to the outside atmosphere and it functions as a conventional atmospheric vent line. We found that using a positive pressure line having an inside diameter of approximately 9 mm and a capture tube having a mouth of about 16 mm produces pressure differentials in the order of 0 to 0.1 psi under normal operating conditions. A calibrated orifice 34 with an opening from approximately 1.4 mm to approximately 3.5 mm may be used in the line to adjust this pressure range to fit particular needs of different engines.

In the course of additional experimentation to fit the kit of this invention to a large variety of carburetted engines, we found that other sources may be tapped within the engine to produce the necessary positive pressure. For example, we found that an alternator's cooling fan produces sufficient draft to create a 0 to 0.11 psi pressure differential in the chamber 10 when used with a capture tube and plumbing of the sizes described above. Since the rotational speed of an alternator is normally directly proportional to the engine's speed, this configuration will also provide greater pressure differentials at greater engine speeds, as a radiator fan normally does.

This invention functions by utilizing the contemporaneous effect of the above-described pressure source and of a vacuum source connected to it. Accordingly, a negative pressure line 30 (of size comparable to that of line 20) is tapped into the intake manifold 2 of the engine (anywhere downstream of the throttle valve 8) and is connected to the positive pressure line 20 by means of a fitting 32, such as a plain T coupling, near the tap 22 to the float chamber. Thus, the chamber is pneumatically connected also to a competing vacuum source and the pressure in the chamber is the net effect of the positive pressure produced by the fan 26 and the negative pressure produced by the intake manifold 2. Since the negative pressure produced at the intake manifold is normally in the order of 8 psi (as compared to the positive pressures of 0 to 0.1 psi generated by a radiator fan), it is apparent that the net effect of an uncontrolled system would be to always provide a strong negative pressure to the chamber, resulting in a much leaner fuel mixture than produced by a conventional carburetor. In fact, the strong vacuum would suck fuel out of the chamber and tend to stall the engine. Therefore, the net pressure differential produced in the float chamber is regulated by controlling the flow through the vacuum line 30 by means of a solenoid valve 36. When the valve 36 is closed, the positive pressure of line 20 is the only effect produced in the float chamber 10, resulting in a maximum positive pressure differential on the fuel. As the valve 36 opens and the positive pressure begins to bleed into the intake manifold through line 30, the pressure differential in the chamber 10 decreases until it becomes zero when the positive differential in line 20 equals the negative differential in line 30. Beyond that point the vacuum source prevails and begins to draw also from the float chamber's atmosphere, thus creating a negative pressure differential that increases with the further opening of valve 36. We found that a negative pressure differential of 0 to 0.1 psi can be produced in a controlled manner in the float chamber by means of this system. This range of negative pressure differential is found to be optimal to practice the invention with most commercial automotive engines.

In order to actuate the valve 36 in a feedback control mode, it is actuated by an electronic controller 38, which in turn is driven by an oxygen sensor 40 placed in the engine's exhaust manifold upstream of the catalytic converter 42 (if one is present in the system). As shown in other prior art apparatus, the oxygen sensor 40 produces a voltage directly related to the oxygen content in the exhaust. This oxygen content is a very accurate indicator of the degree of fuel combustion in the engine and, therefore, also of the deviations of the intake air-fuel mixture from its stoichiometric ratio. Accordingly, the voltage produced by the sensor 40 gives a quantitative measure of the deviations from the optimal air-fuel ratio under all operating conditions. Typically, the sensor 40 generates a voltage varying from 0 to 1 volts, and it is calibrated to produce 450 millivolts when the intake air-fuel mixture is stoichiometric (i.e., when maximum combustion occurs). The voltage produced by the oxygen sensor is converted by the electronic controller 38 into a corresponding actuating signal to the solenoid valve 36. When the voltage is less than 450 millivolts, indicating a lean mixture, the controller causes the valve to reduce the flow through line 30, thus increasing the net pressure differential in the float chamber and producing a mixture richer in fuel. The opposite happens, of course, when the voltage is greater than 450 millivolts.

Figure 3:
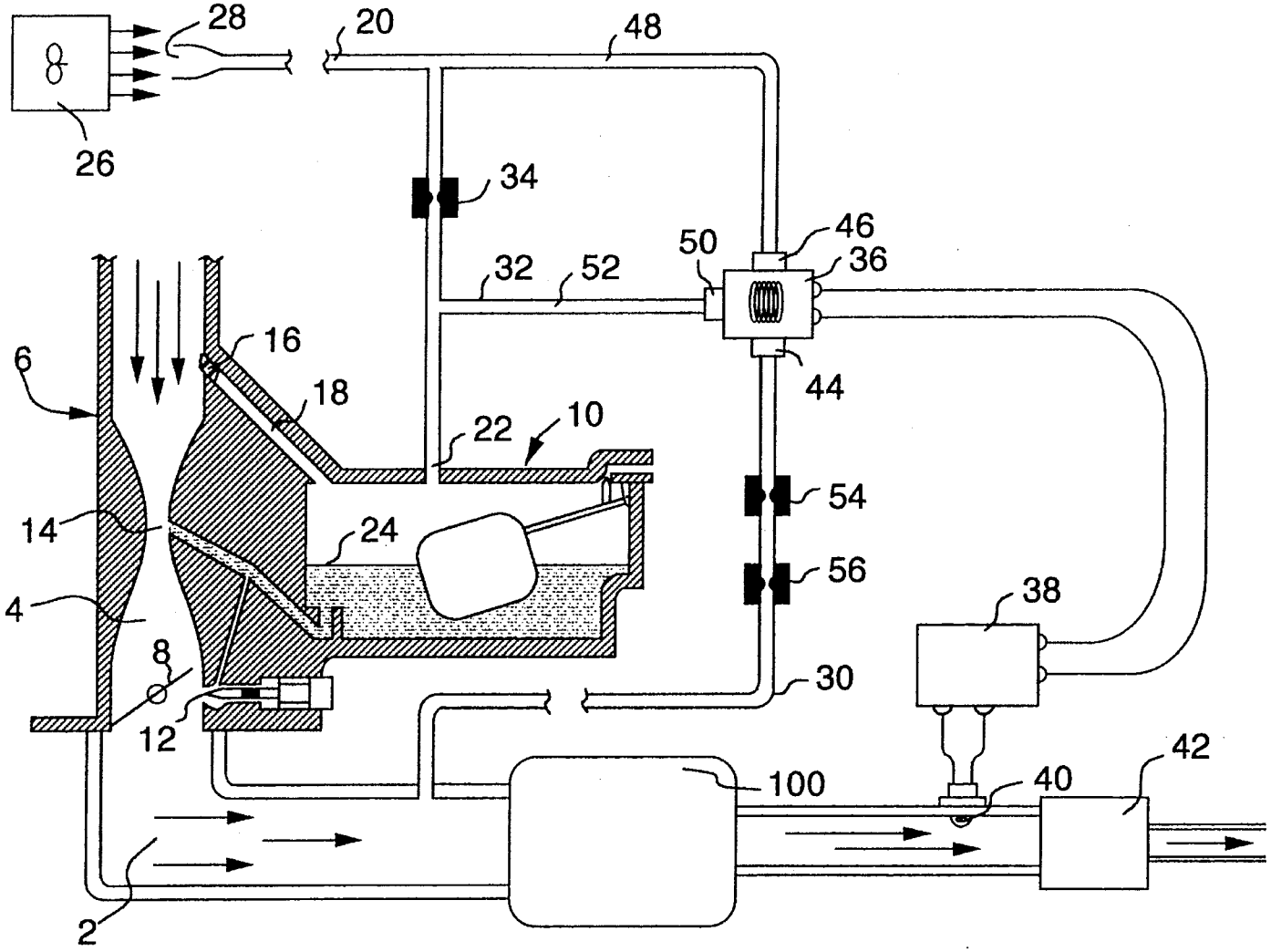
FIG. 3 is a schematic view of another embodiment of the invention containing an additional positive-pressure bypass line connected to a second input port of the control valve.

We found that the action of a cycling vacuum solenoid valve 36, such as the FCV valve sold by IMPCO Technologies, Inc. of Cerritos, Calif., instead of the linear action of a metering (proportional) valve is greatly preferred for implementing this invention because of the much faster response time it is able to provide. This type of valve can be operated either with a single input port (as illustrated in FIG. 2) or with two input ports 44 and 46, as shown in FIG. 3 and described below. In a single input-port configuration, the valve is normally closed and operates by cyclically opening the port at higher or lower frequencies depending on whether a higher or lower throughput is desired, respectively. Therefore, the flow through this valve is controlled simply by varying the frequency of the electrical input signal (pulse) to it, which either increases or decreases the rate of periodic opening of a dynamic flow-regulating component in the valve. No stepper-type motor is required to either open or close an otherwise static flow-regulating component in the valve, as in the case of proportional metering valves. Thus, the response time of a cycling solenoid valve is greatly reduced by eliminating the inertial effect of an intermediate mechanical driving device (motor) and of a static flow-regulating component. In addition, the electronic control logic required to drive a metering valve is more complicated, resulting in an overall significantly more expensive and less responsive system. We found that an electronic controller such as Part No. AFCP-1, also marketed by IMPCO Technologies, Inc., and the oxygen sensor sold by General Motors of Canada Limited, of Oshawa, Ontario, under Part No. 251 059 01 are excellent components for use in implementing the present invention in conjunction with the solenoid valve referenced above.

In operation, the controller 38 is calibrated to produce a maximum rate of cycling of the valve 36 when the oxygen sensor measures a low oxygen content corresponding to a rich fuel mixture (i.e., the voltage produced by the sensor is at its higher range), thus producing maximum vacuum in the fuel bowl and, correspondingly, a leaner mixture in the venturi tube. A minimum rate of cycling, which produces minimum throughput in the valve and maximum positive pressure in the float chamber, is conversely desired when the sensor measures a high oxygen content in the exhaust (corresponding to a lean fuel mixture). Note that this type of valve approaches a totally open or closed state by varying the rate at which it cycles between the two conditions. The result is that some vacuum effect from the manifold is felt even when the valve is cycling at its slowest rate.

In practice, a further refinement to the invention consists of using both input ports of the vacuum valve 36, as illustrated in FIG. 3. A positive-pressure bypass line 48 is used to connect the second input port 46 of the valve 36 to the main positive pressure line 20 (the recommended size of line 48 is approximately the same as that of lines 20 and 30). This additional flow rate from the positive-pressure line 20 is fed to the float chamber through the output port 50 when the second input port 46 is open and the first input port 44 is closed. Since the second port 46 is normally open while the first port is normally closed, the cycling effect of the two ports is opposite (the two ports operate on cycles that are 180 degrees out of phase). That is, a low frequency corresponds to a high positive-pressure line throughput and a low negative-pressure line throughput. As the cycle frequency of the valve is increased, not only is the vacuum line throughput increased but the positive-pressure line throughput is concurrently decreased, thus enhancing the response time of the system. Obviously, the direction of flow in the valve output line 52 depends on the net pressure drop within it as a result of the pressure at the connecting fitting 32 and the position of the flow-controlling components in ports 44 and 46. When this embodiment of the invention is used (which is preferred because of its greater versatility of operation) the calibrated orifice 34 is utilized to produce fine adjustments to the maximum positive pressure provided to the float chamber. Similarly, both embodiments shown in FIGS. 2 and 3 may utilize calibration orifices 54 and 56 (more than one orifice may be necessary in order to utilize standardsize orifices available in commerce) ranging in size from about 0.35 mm to about 1.45 mm to regulate the maximum negative pressure transmitted upstream from the intake manifold 2. The exact sizing of these orifices permits the fine tuning of the system to the requirements of specific engines.

Figure 5:
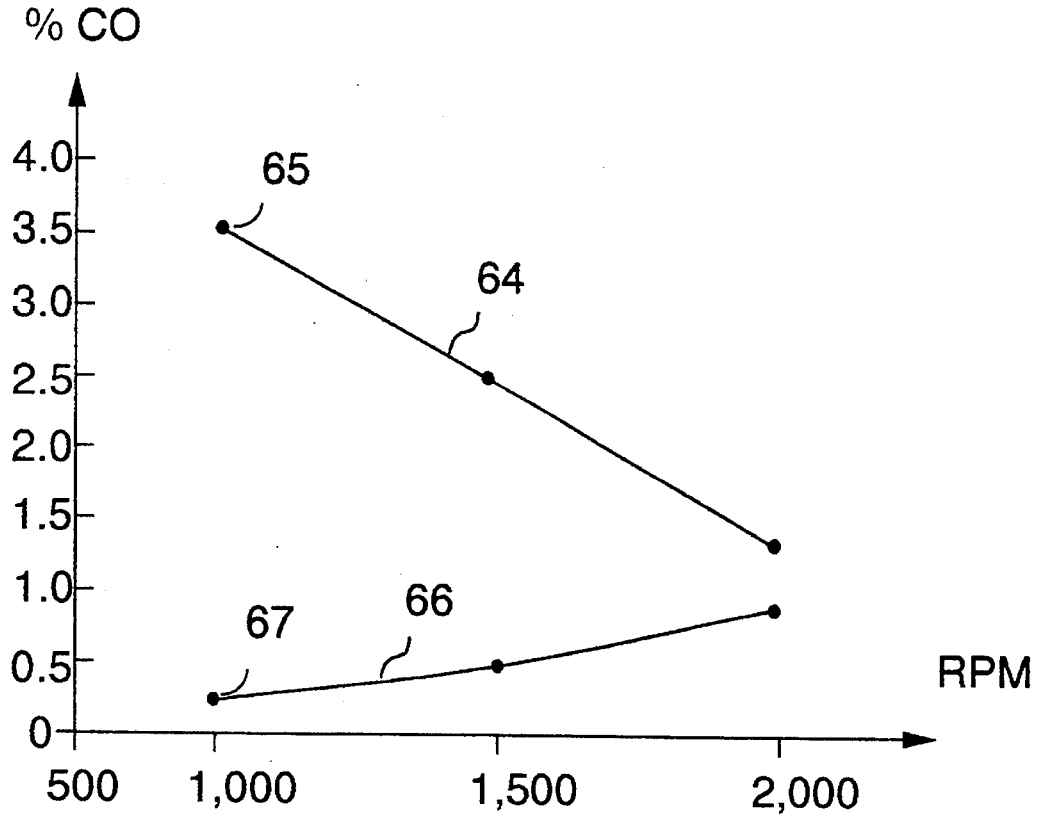
FIG. 5 is a graph illustrating the performance of the apparatus of the invention in reducing carbon monoxide emission.
Figure 4:
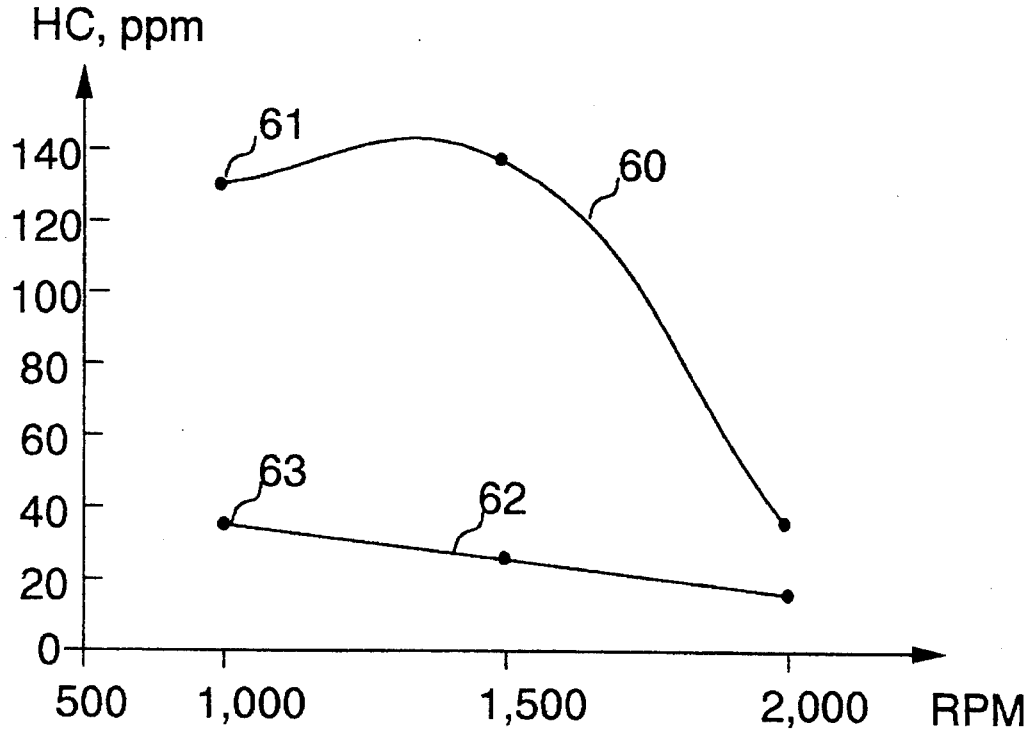
FIG. 4 is a graph illustrating the performance of the apparatus of the invention in reducing hydrocarbon emission.

FIGS. 4 and 5 illustrate the performance of this embodiment of the invention as measured by the content of emission pollutants in the exhaust of a 1966 350-cubic-inch Chevrolet truck engine being operated with and without the float chamber pressure control. The apparatus of the invention was calibrated by using an opening of 2.5 mm for the orifice 34 and openings of 0.87 mm and 0.77 mm for the orifices 54 and 56, respectively. Carbon monoxide and hydrocarbons contents were measured with an Allen EPA Emissions 4-Gas Analyzer. Line 60 in FIG. 4 is based on data points 61 showing the hydrocarbon content at different engine speeds with standard carburetion equipment. Line 62 (based on data points 63) shows the corresponding reduced hydrocarbon content when the carburetor is modified according to the present invention. Lines 64 and 66 in FIG. 5 (based on sets of data points 65 and 67, respectively) illustrate comparable results for carbon monoxide content with and without the float control, respectively. Lines 62 and 66 represent measurements taken upstream of a catalytic converter. After conversion in the catalytic converter, the emissions showed no measurable remaining traces of carbon monoxide and a further significant reduction of hydrocarbons.

In applying the carburetor kit of this invention to small engines, such as Volkswagen Beetle 4-cylinder engines, we found that the systems shown in FIGS. 2 and 3 produce pressure variations in the float chamber that tend to be too cyclical for a smooth and stable operation. Adjustments to the sizes of the various orifices in the lines were not sufficient to produce a satisfactory control response in the float chamber. Therefore, we further modified the basic concept of the invention to provide additional dampening of the net pressure effect felt in the float chamber.

Figure 6:
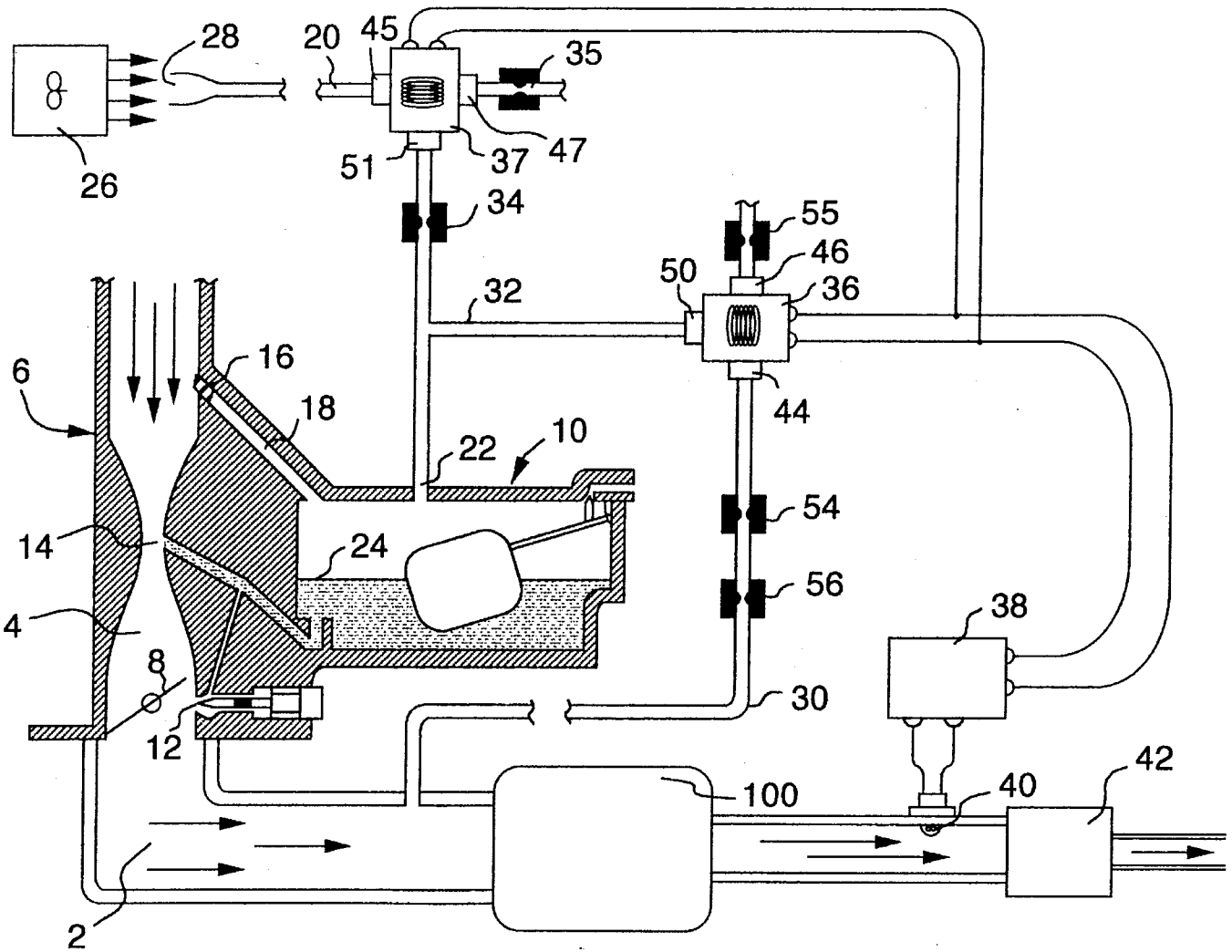
FIG. 6 is a schematic view of another embodiment of the invention containing a positive-pressure line and a negative-pressure line pneumatically connected to the engine's radiator fan and intake manifold, respectively, wherein the flow through each line is regulated by a separate control valve responsive to the oxygen content in the exhaust gases.

Thus, in another embodiment of the invention shown in FIG. 6, two separate equivalent valves 36 and 37 are used, connected to the negative pressure line 30 and the positive pressure line 20, respectively. These valves have first input ports 44 and 45 connected to the vacuum and pressure source, respectively, and output ports 50 and 51 connected to the lines leading to the float chamber 10. Second input ports 46 and 47 in each valve are vented to atmosphere, possibly through metering orifices 35 and 55, if such is required to control the effect of the atmospheric pressure. These two valves are electrically wired in parallel, so as to receive the same cycling signal from the electronic controller 38, but with the two input ports connected in reverse, so that when one valve is vented the other is open to a pressure source. That is, valve 36 is normally closed to the vacuum source, while valve 37 is normally open to the pressure source. Therefore, when valve 36 is open to vacuum, valve 37 is vented; when valve 36 is vented, valve 37 is open to the positive pressure source.

As for the single-valve case explained above (see FIG. 2), the controller is calibrated to produce a maximum rate of cycling of both valves 36 and 37 when the oxygen sensor measures a low oxygen content (corresponding to a rich fuel mixture). Since this causes valve 36 to be open to the negative pressure source more than valve 37 is open to the positive pressure source (which is also smaller in magnitude), the net result is that a vacuum is produced in the fuel bowl and, correspondingly, a leaner mixture in the venturi tube. On the other hand, a minimum rate of cycling in the valves is produced when the sensor measures a high oxygen content in the exhaust (corresponding to a lean fuel mixture). This produces minimum throughput from the vacuum source and maximum throughput from the positive pressure source, which in turn results in a net positive pressure being applied to the float chamber. We found that having two second input ports (46 and 47) vented to atmosphere provides a dampening effect to the cycling operation of the valves, whereby the output pressures at ports 50 and 51 fluctuate around the baseline atmospheric pressure, rather than between the maximum negative and positive pressures provided by the negative and positive pressure sources. Thus, the configuration illustrated in FIG. 6 produces a smoother control action on the pressure in the float chamber, which reduces the oscillations that in some engines yield an unstable operation using the systems of FIGS. 2 or 3. Note that at steady state operation the net effect of the two valves 36 and 37 could also be achieved simply by a proper use of the orifices in the lines, but this solution would not afford the same flexibility and range of operation. If, for example, the orifice 34 were used to restrict the positive-pressure line sufficiently to create the proper net pressure in the chamber 10 at high rpm, the positive-pressure line may be too restricted to permit proper functioning during acceleration.

Tables 1 and 2 below illustrate the performance of the embodiment of the invention illustrated in FIG. 6 as measured by emission tests performed on a 1989 Volkswagen Beetle 4-cylinder engine being operated with and without the float chamber pressure control. This embodiment of the invention was tested without any calibration orifices in the lines. Carbon monoxide (CO), carbon dioxide ($CO_2$), nitrous oxides ($NO_x$), hydrocarbons (HC) and gasoline mileage efficiency were measured according to requirements of EPA Test CVS-75.

TABLE 1

| Engine Without Carburetor Control Equipment | | | |
|---|---|---|---|
| CO | (g/Km) | = | 38.35 |
| $CO_2$ | (g/Km) | = | 175.82 |
| $NO_x$ | (g/Km) | = | 1.18 |
| HC | (g/Km) | = | 0.85 |
| Mileage | (Km/l) | = | 10.03 |

TABLE 2

| Engine With Carburetor Control Equipment | | | |
|---|---|---|---|
| CO | (g/Km) | = | 4.79 |
| $CO_2$ | (g/Km) | = | 221.58 |
| $NO_x$ | (g/Km) | = | 0.37 |
| HC | (g/Km) | = | 0.27 |
| Mileage | (Km/l) | = | 10.42 |

It is apparent from the results shown in the tables that the kit of the invention improved substantially the emissions of pollutants under test conditions. Correspondingly, as expected, a higher $CO_2$ emission and better mileage reflected more complete combustion of the fuel.

By controlling the size of the orifices 35 and 55, the capacity of the vented port of each valve can be regulated to provide specific adjustments that are needed to optimize the performance of the invention with particular engines. At the limit, either or both orifices can be plugged off, thus eliminating the effect of the atmospheric pressure on the corresponding pressure source. The combination of two separate valves controlling the flow from the positive and negative pressure sources and the various orifices in the system provides great flexibility in fine tuning the system to the requirements of particular engines. If either or both of the valves 36 and 37 are not vented to atmosphere as shown in FIG. 6, but are, rather, operating without a connection to the atmosphere, the system produces the same controlling functions but is not dampened and is more responsive to variations in the exhaust's oxygen content. We found that in some engines this produces oscillations that diminish the effectiveness of the control. Therefore, the vented configuration is recommended for smaller engines that, as we discovered, tend to require finer adjustments to achieve a smoother control response.

Figure 7:
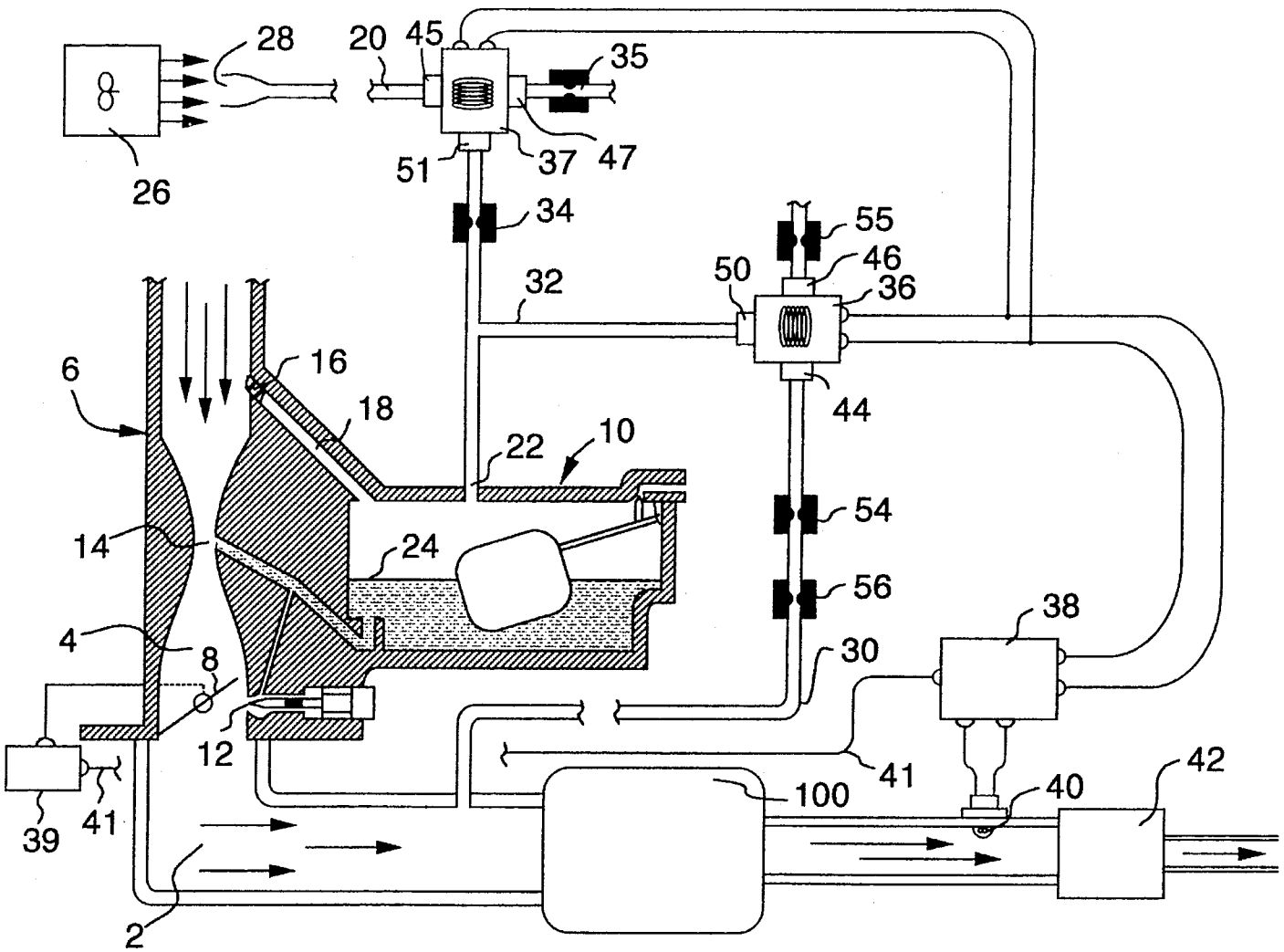
FIG. 7 is a schematic view of yet another embodiment of the invention having the same configuration of FIG. 6 and further comprising sensor means responsive to acceleration and deceleration conditions in the engine for sending a corresponding signal to the electronic control means.

Another area of sub-optimal performance results from the fact that, as mentioned above, cycling solenoid valves, when used in conjunction with control apparatus of the type disclosed, cycle between open and closed conditions. Therefore, to some degree the effect of the vacuum source may be felt through valve 36 even when it would be desirable to have maximum positive pressure applied to the float chamber, such as during acceleration, when a rich mixture is needed for high performance. This can be achieved by modifying the electronic controller 38 to include circuitry that, when acceleration conditions are present, would override the normal response to the input provided by the oxygen sensor 40 and cause instead valve 36 to remain closed to the vacuum source. Similarly, the system can be further optimized by causing valve 37 to remain closed to the positive pressure source when a lean fuel/air mixture is sufficient for engine operation, such as during deceleration conditions. As shown in schematic form in FIG. 7, a sensor means 39 can be utilized to determine acceleration and deceleration conditions, such as by sensing the direction and speed of motion of the throttle 8 in the carburetor and sending a corresponding signal to the controller 38 through appropriate wiring connections 41. These features would eliminate altogether the influence of the negative and positive pressures when undesirable at critical stages of engine operation. Note that other, equivalent means for detecting acceleration and deceleration could be used, such as means detecting the rate of change of the vacuum in the intake manifold 2, or any other operating parameter that varies when engine operation shifts from steady state to a higher or lower speed.

Figure 8:
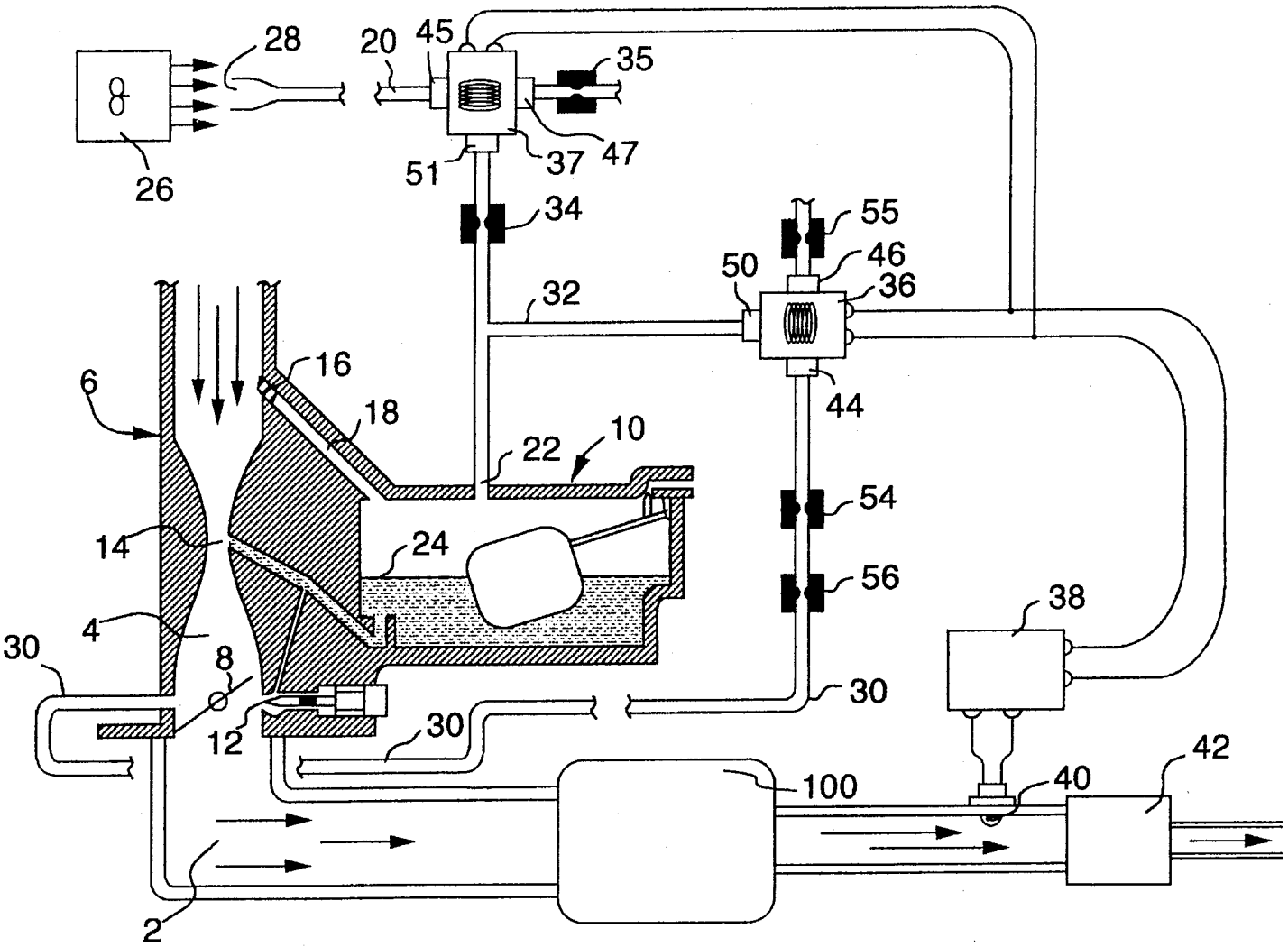
FIG. 8 is a schematic view of still another embodiment of the invention having the same configuration of FIG. 6, wherein the negative pressure line is connected to the carburetor upstream of the throttle.

As a partial step toward achieving these improvements without the additional complication of utilizing the sensor means 39, we found that the vacuum source line 30 may be connected to the carburetor immediately upstream of the throttle 8 (referred to in the industry as a ported vacuum), rather than to the intake manifold 2. As seen in FIG. 8, a tap 31 so placed is affected by the position of the throttle, whereby the vacuum produced is nearly zero when the throttle is closed (i.e., at idle conditions). Therefore, the float chamber 10 is subjected to maximum positive pressure to produce a rich mixture, which is what is needed for good acceleration performance from idle conditions.

Figure 9:
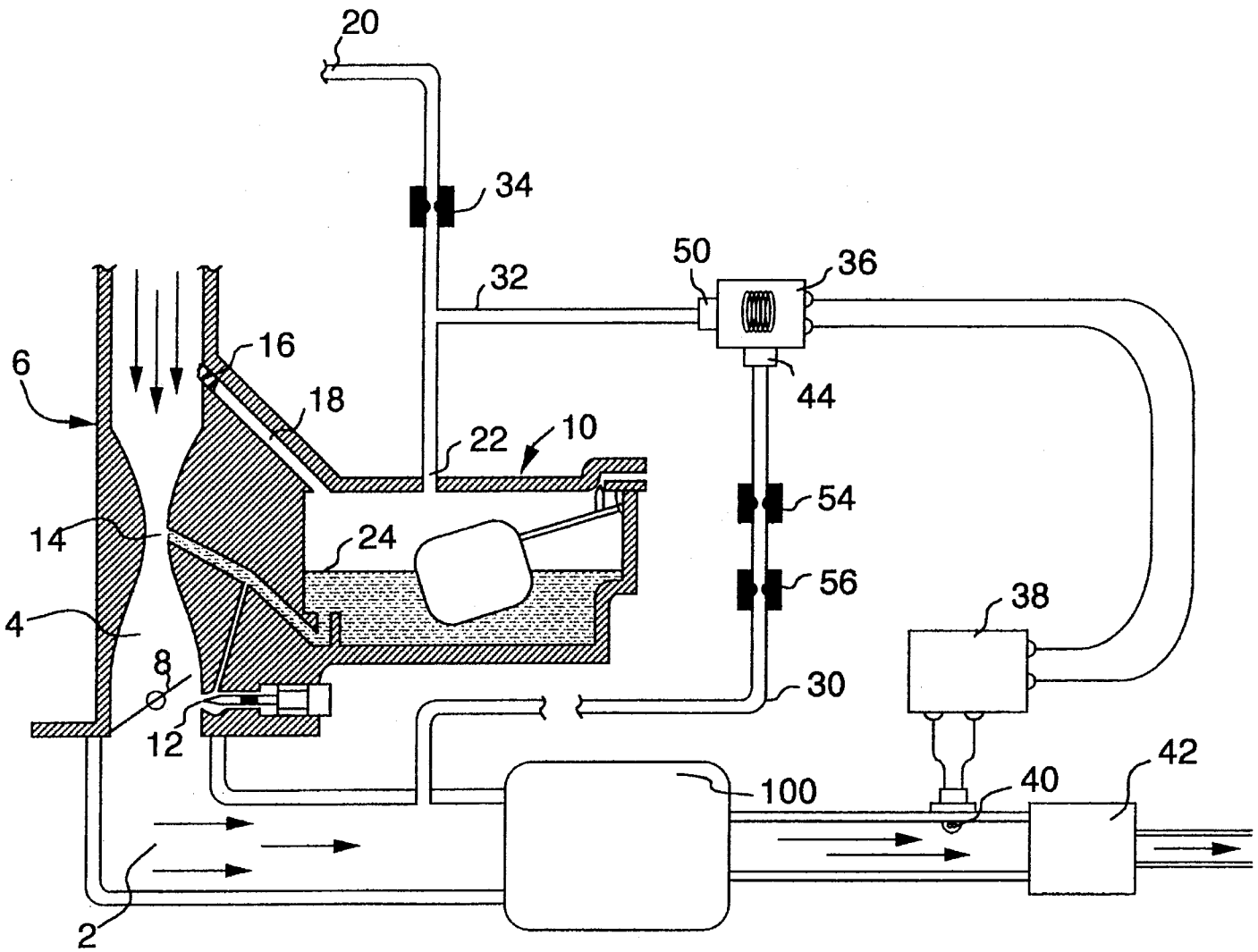
FIG. 9 is a schematic view of another embodiment of the invention having the same configuration of FIG. 2, but without a positive pressure source.

It should also be noted that some engines are carburetted with a very rich fuel/air mixture under idle conditions. For these engines the positive pressure provided by the fan 26 becomes unnecessary because the mixture is sufficiently rich under all conditions and only vacuum adjustments are required to bring the mixture within stoichiometric balance. Therefore, in these cases a simple connection to atmosphere, as shown in FIG. 9, is sufficient to achieve acceptable results.

Note that this invention is designed primarily for use on older vehicles that do not have a catalytic converter in their exhaust system, which most countries in the world do not yet require. In order to improve the quality of emissions of these vehicles by means of retrofit apparatus, the addition of catalytic converters and a switch to unleaded fuels constitute a proven and relatively inexpensive solution. The remaining problem is the fact that uncontrolled conventional carburetors tend to run too rich at low engine speeds, which greatly affects the performance and shortens the normal life of a catalytic converter. Moreover, catalytic conversion is directly related to the air-fuel ratio, being most efficient when the ratio is nearly stoichiometric (that is, about 14.7 to 1 fuel to air ratio by weight under normal conditions). Therefore, by also installing the apparatus of this invention, the performance and life of the converter are greatly improved. The life is lengthened to a duration comparable to that found in modern vehicles that contain factory-built feedback control.

In view of these results, it is apparent that this invention provides a relatively simple and inexpensive apparatus for improving significantly the performance of existing equipment. The installation of the invention requires few additional components and minimal modifications to standard equipment (a plug in the carburetor and taps in the carburetor and intake manifold). Therefore, it is particularly suitable for after-market application on carburetted older vehicles that are not equipped with a feedback emission control system.

We found that regulating the effect of the intake manifold vacuum on the float chamber is sometimes difficult under severe acceleration and deceleration conditions. Because of the high vacuum available, the negative pressure applied to the chamber is at times greater than optimal, especially under very hot operating conditions. This results in very lean conditions and hesitation under acceleration.

In order to correct this potential problem and in a continuing effort to develop a carburetor kit for universal after-market application, we have designed yet another embodiment of the invention that incorporates a stabilizing circuit with the features of the above-described designs. Moreover, we have strived for a design that has built-in capabilities for optimal performance under all operating conditions with less consideration given to specific vehicle characteristics and greater reliance on sophisticated control devices. Thus, as illustrated in schematic form in FIG. 10, the preferred embodiment of the invention consists of a kit that utilizes the engine's intake manifold as the negative pressure source and its exhaust manifold as the positive pressure source connected to the fuel bowl of the carburetor. In addition, an air bypass to the venturi tube in the carburetor may be also utilized to accurately control the fuel mixture at idle and at very-light load conditions. The flow through each line is regulated by four solenoid valves driven by an electronic controller responsive to critical parameters during the entire cycle of operation.

Figure 10:
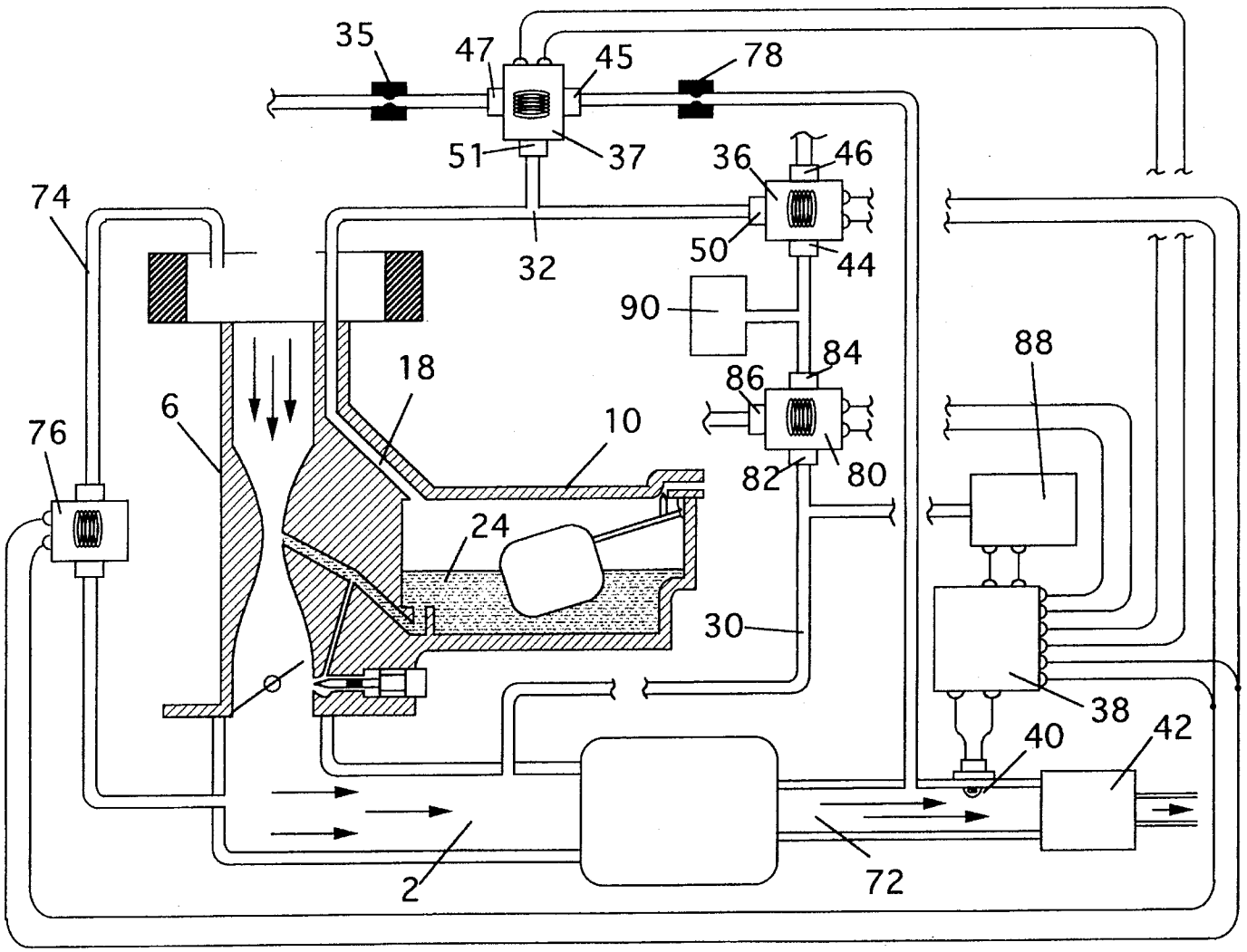
FIG. 10 is a schematic view of the preferred embodiment of the invention containing a positive-pressure line and a negative-pressure line pneumatically connected to the engine's exhaust and intake manifold, respectively, and a venturi-tube air bypass, wherein the flow through each line is regulated by control valves responsive to an air-fuel mixture controller.

Referring to FIG. 10, rather than tapping into the wall of the float chamber 10 to provide a connection for delivering a positive or negative pressure differential, the atmospheric vent 18 is utilized, preferably through the air filter 70 that commonly rests above the carburetor's intake. Note that an embodiment utilizing a tap 22 on the float chamber wall, as illustrated in the figures for the previous embodiments, would be equivalent to this configuration. Thus, as in the embodiment of FIGS. 7 and 8, the float chamber 10 is adapted to receive a negative pressure differential through a three-port vacuum valve 36 that has a first input port 44 in communication with the engine's intake manifold 2, a vented second input port 46, and an output port 50 in communication with the float chamber 10. Similarly, the chamber is adapted to receive a positive pressure differential through a three-port pressure valve 37 that has a first input port 45 in communication with the engine's exhaust manifold 72 as a source of positive pressure, a vented second input port 47, and an output port 51 in communication with the float chamber 10 through a connecting fitting 32. In addition, this embodiment may comprise an air bypass line 74 connecting the intake manifold 2 to atmosphere, preferably at a point within the air filter 70, and the air flow through line 74 is controlled by a bypass two-port valve 76. An electronic controller 78 is used to regulate the function of valves 36, 37 and 76, as explained in detail below.

Referring to each valve in particular, the pressure valve 37 is controlled to function exactly as described for the other embodiments of the invention but the positive pressure is provided by tapping into the exhaust manifold 2, which produces greater pressure differentials during acceleration, when it is most needed. The vented port 47 provides a dampening effect to the cycling operation of the valve, whereby the output pressure at port 51 fluctuates between the exhaust manifold's pressure (possibly reduced by a metering orifice 78) and atmospheric pressure. Similarly, the vacuum valve 36 functions exactly as in the embodiment described in FIGS. 7 and 8, with both valves 36 and 37 being controlled by the controller 38 as described with reference to that embodiment. That is, these two valves may be electrically wired in parallel, so as to receive the same cycling signal from the electronic controller 38, but with the two input ports connected in reverse, so that when one valve is vented the other is open to a pressure source. That is, valve 36 is normally closed to the vacuum source, while valve 37 is normally open to the pressure source. Therefore, when valve 36 is open to vacuum, valve 37 is vented; when valve 36 is vented, valve 37 is open to the positive pressure source. Alternatively, these two valves may be controlled independently by the controller 38 to perform the function of providing a positive pressure differential when the fuel mixture is lean and a negative pressure differential when it is rich.

In order to better control the effect of the potentially large negative pressure differential from the intake manifold 2, an additional three-port regulator valve 80 may be used in series with valve 36, as shown in FIG. 10. The first input port 82 of the valve is connected to the intake manifold, the second input port 86 is vented, and the output port 84 is connected to the first input port 44 of valve 36. Thus, valve 80 functions as a variable orifice to restrict the line 30 between the vacuum valve 36 and the intake manifold. A manifold absolute-pressure sensor 88 is provided to monitor the manifold pressure and to provide a corresponding input to the controller 38 which in turn is used to generate a control signal for valve 80. When the manifold pressure indicates a very low vacuum, as measured by a predetermined floor value, the solenoid valve 80 is cycled open to apply full vacuum to the input port 44 of valve 36; when the manifold pressure indicates a high vacuum, as measured by a predetermined ceiling value, the valve is cycled closed to apply very little negative pressure to the input port 44 of valve 36. Between these two limit conditions, valve 80 is operated so as to produce intermediate degrees of negative pressure, preferably in linear fashion. Finally, an accumulator chamber 90 may be placed between the regulator valve 80 and the vacuum valve 36 in order to dampen the vacuum pulsations due to the cycling characteristics of valve 80.

Note that the use of valve 80 in combination with the accumulator chamber 90 makes it possible to fine tune the utilization of the vacuum generated by the engine, which would otherwise be too strong under most operating conditions for direct application to the float chamber. In fact, the main reason for using positive pressure (or atmospheric pressure) concurrently with vacuum (through valves 37 and 36) in all previous embodiments of the invention is to retain a fast dynamic response to operating changes while also coping with the relatively great levels of vacuum provided by the intake manifold. The addition of the regulator valve 80 and the accumulator chamber 90 make it possible to make fine vacuum adjustments without using positive or atmospheric pressure as a compensating component. Thus, for example, in the preferred method of operation, positive pressure is applied to the float chamber only when the oxygen sensor 40 produces a voltage below 450 millivolts (that is, when the intake air-fuel mixture is leaner than stoichiometric) and, at the same time, the intake manifold vacuum is between 5 and 12 inches of mercury (characteristic of idle conditions) and valve 36 is open to atmosphere. That is, the controller 38 is programmed to provide positive pressure to the float chamber only when a positive pressure differential can no longer be obtained simply by reducing the vacuum applied through valve 36. Since some engines operate always under rich-mixture conditions, the positive pressure circuit and valve 37 may be eliminated altogether, as illustrated in FIG. 11, and optimal air/fuel ratio conditions can be achieved simply by controlling the vacuum applied to the float chamber by the combination of a vacuum valve 36 and a regulator valve 80.

In yet another improvement of the present invention, an air bypass line 74 and a bypass valve 76 are utilized to accurately regulate the air-to-fuel ratio at idle and under very-light load conditions. At idle it is difficult to effect a smooth control of the fuel/air mixture simply by varying the pressure in the fuel bowl because of the relatively high pressure differentials available. Therefore, we found that optimal fuel-mixture control at idle is more easily accomplished by changing the amount of air intake from the carburetor, rather than the amount of fuel from the float chamber. If the mixture is too rich, valve 76 is cycled to allow more air through the bypass line 74 so that the vacuum at the intake manifold is reduced, which in turn reduces the fuel rate drawn through the idle circuit and makes the mixture leaner. Conversely, if the mixture is too lean, valve 76 is cycled closed to reduce the air bypass and increase the vacuum at the intake manifold, thus increasing the flow of fuel and enriching the mixture. Valve 76 may be wired in parallel with valve 36, but in practice at idle conditions it provides most of the control function because the very high sensitivity of the float chamber's pressure to the application of manifold vacuum tends to cause the regulator valve 80 to operate at a predetermined minimum throughput and allow minimal vacuum to be available for application to the float chamber. Thus, under these conditions the effect of the vacuum circuit through valve 36 is minimized and the bypass line 74 is effectively the main source of regulation. As is well understood by those skilled in the art, the amount of air passed through the bypass circuit is a function of the size of line 74 and of the cycling characteristics of valve 76; and the maximum effect is obviously seen at idle because of the relatively low flow rate through the venturi tube which the bypass air is affecting. As the engine accelerates and the venturi throughput increases, the incremental air provided by the bypass line becomes a smaller and smaller percentage of total flow rate and its effect is diminished.

Thus, in operation, if the air/fuel mixture controller 38 is responding to a rich mixture condition, the bypass solenoid valve 76 is cycled more rapidly and causes more air to pass through line 74. This will in turn decrease air flow rate through the venturi and reduce vacuum to the idle circuit, which results in less fuel delivery through the idle circuit. If, on the other hand, the air/fuel mixture controller 38 senses a lean condition, the two-way bypass valve 76 decreases its duty cycle and reduces air bypass through line 74, which will in turn cause the air flow through the venturi and the manifold intake vacuum to increase and, correspondingly, to increase fuel delivery.

Figure 11:
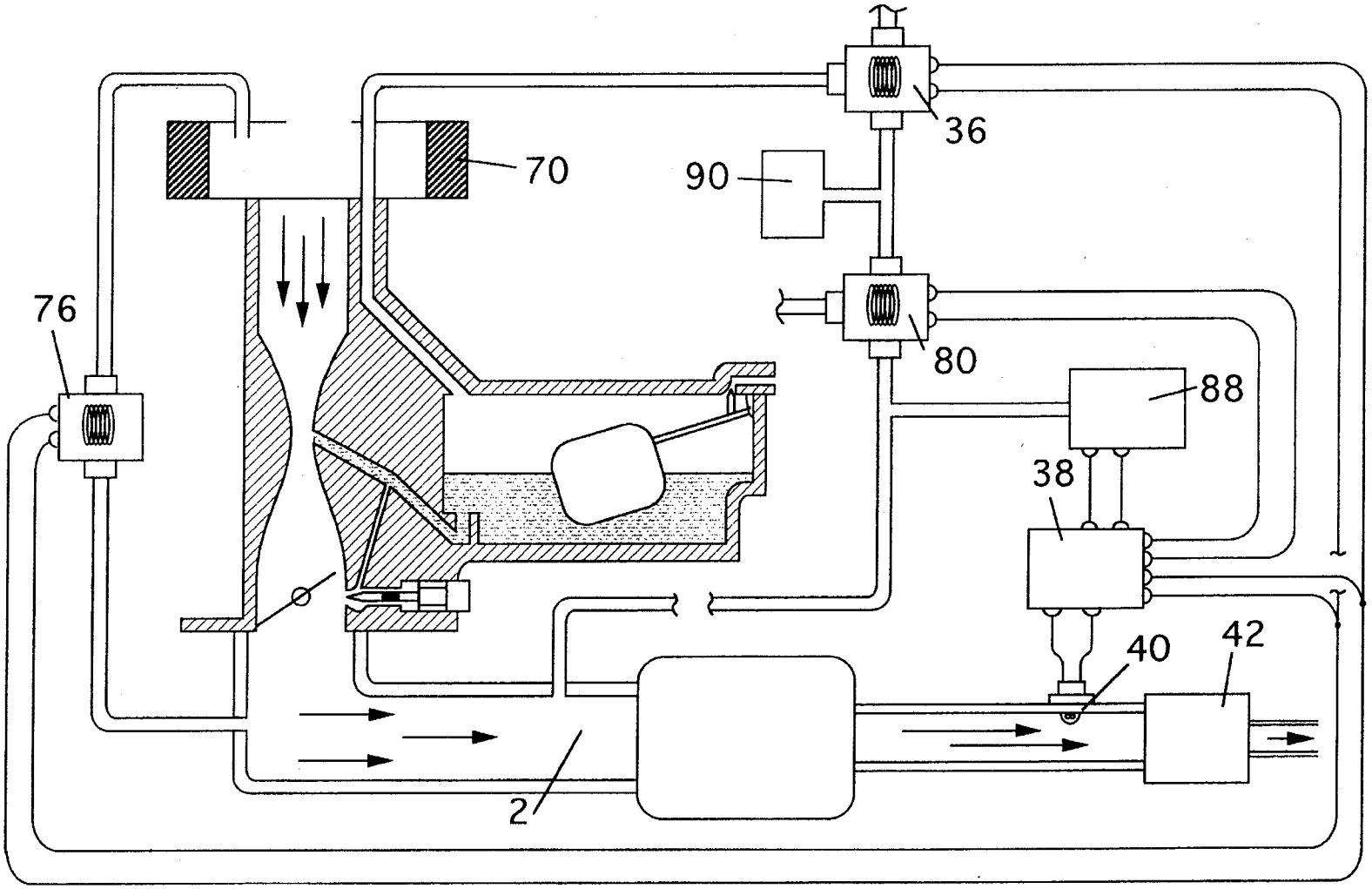
FIG. 11 is a schematic view of yet another embodiment of the invention containing a negative-pressure line pneumatically connected to the engine's intake manifold through a regulator-valve and accumulator-chamber system.

Thus, because of its flexibility of operation, the embodiments shown in FIGS. 10 and 11 are suitable for stable and effective control of most carburetted motor vehicles. While these embodiments feature the specific components and physical structures therein described, the invention can obviously take other forms with equivalent functionality and utility. Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

We claim:

1. A carburetor kit for improving the emissions of internal-combustion engines having an exhaust manifold generating a positive-pressure gas stream and a carburetor wherein an air-fuel mixture is produced by drawing fuel from a fuel float chamber into an air stream flowing through a venturi tube as a result of a vacuum provided at an intake manifold, comprising:

(a) first pneumatic passage means for connecting the float chamber of the carburetor and the exhaust manifold, so that a positive pressure differential is available for application to the float chamber;

(b) second pneumatic passage means for connecting the float chamber and the intake manifold, so that a negative pressure differential is available for application to the float chamber;

(c) first valve means for controlling the flow rate through said first pneumatic passage means;

(d) second valve means for controlling the flow rate through said second pneumatic passage means;

(e) sensor means for measuring the oxygen content of exhaust gases of the engine and for generating a signal corresponding to said oxygen content; and (f) first electronic control means for actuating said first valve means in response to the signal generated by said sensor means, such that a flow rate through said first valve means is progressively reduced as the oxygen content in the exhaust gases decreases and is progressively increased as the oxygen content in the exhaust gases increases; and for actuating said second valve means in response to the signal generated by said sensor means, such that a flow rate through said second valve means is progressively reduced as the oxygen content in the exhaust gases increases and is progressively increased as the oxygen content in the exhaust gases decreases.

2. The apparatus of claim 1, further comprising third valve means connected in series with said second valve means for regulating said negative pressure differential available for application to the float chamber.

3. The apparatus of claim 2, further comprising second electronic control means for actuating said third valve means in response to the signal generated by said sensor means, such that a flow rate through said third valve means is progressively reduced as the oxygen content in the exhaust gases increases and is progressively increased as the oxygen content in the exhaust gases decreases.

4. The apparatus of claim 2, further comprising accumulator means connected between said third and second valve means for dampening an output of said third valve means.

5. The apparatus of claim 3, further comprising accumulator means connected between said third and second valve means for dampening an output of said third valve means.

6. The apparatus of claim 1, further comprising a bypass line connected in parallel to said venturi tube and comprising fourth valve means in said bypass line for regulating a flow of said air stream through the bypass line.

7. The apparatus of claim 6, further comprising second electronic control means for actuating said fourth valve means in response to the signal generated by said sensor means, such that a flow rate through said fourth valve means is progressively reduced as the oxygen content in the exhaust gases increases and is progressively increased as the oxygen content in the exhaust gases decreases.

8. The apparatus of claim 3, further comprising a bypass line connected in parallel to said venturi tube and comprising fourth valve means in said bypass line for regulating a flow of said air stream through the bypass line.

9. The apparatus of claim 8, further comprising third electronic control means for actuating said fourth valve means in response to the signal generated by said sensor means, such that a flow rate through said fourth valve means is progressively reduced as the oxygen content in the exhaust gases increases and is progressively increased as the oxygen content in the exhaust gases decreases.

10. The apparatus of claim 9, further comprising accumulator means connected between said third and second valve means for dampening an output of said third valve means.

11. The apparatus of claim 1, wherein each of said first and second valve means consist of a solenoid valve that is opened by cyclical pulses transmitted at variable frequency by said first electronic control means.

12. The apparatus of claim 1, wherein said first valve means consists of a solenoid valve having a normally-open first input port connected to said pressure line and having a normally-closed second input port connected to atmosphere and wherein said second valve means consists of a solenoid valve having a normally-closed first input port connected to said vacuum line and having a normally-open second input port connected to atmosphere; and wherein said first and second input ports are opened and closed, respectively, by cyclical pulses transmitted at variable frequency by said first electronic control means.

13. The apparatus of claim 3, wherein each of said first, second and third valve means consist of a solenoid valve that is opened by cyclical pulses transmitted at variable frequency by said first and second electronic control means.

14. The apparatus of claim 3, wherein said first valve means consists of a solenoid valve having a normally-open first input port connected to said pressure line and having a normally-closed second input port connected to atmosphere; wherein said second valve means consists of a solenoid valve having a normally-closed first input port connected to said vacuum line and having a normally-open second input port connected to atmosphere; wherein said third valve means consists of a solenoid valve having a normally-closed first input port connected to said vacuum line in series with the first input port of said second valve means and having a normally-open second input port connected to atmosphere; and wherein said first and second input ports are opened and closed, respectively, by cyclical pulses transmitted at variable frequency by said first and second electronic control means.

15. The apparatus of claim 7, wherein each of said first, second and fourth valve means consist of a solenoid valve that is opened by cyclical pulses transmitted at variable frequency by said first and second electronic control means.

16. The apparatus of claim 7, wherein said first valve means consists of a solenoid valve having a normally-open first input port connected to said pressure line and having a normally-closed second input port connected to atmosphere; wherein said second valve means consists of a solenoid valve having a normally-closed first input port connected to said vacuum line and having a normally-open second input port connected to atmosphere; wherein said fourth valve means consists of a solenoid valve having a normally-closed input port connected to atmosphere; and wherein said first and second input ports are opened and closed, respectively, by cyclical pulses transmitted at variable frequency by said first and second electronic control means.

17. The apparatus of claim 9, wherein each of said first, second, third and fourth valve means consist of a solenoid valve that is opened by cyclical pulses transmitted at variable frequency by said first, second and third electronic control means.

18. The apparatus of claim 9, wherein said first valve means consists of a solenoid valve having a normally-open first input port connected to said pressure line and having a normally-closed second input port connected to atmosphere; wherein said second valve means consists of a solenoid valve having a normally-closed first input port connected to said vacuum line and having a normally-open second input port connected to atmosphere; wherein said third valve means consists of a solenoid valve having a normally-closed first input port connected to said vacuum line in series with the first input port of said second valve means and having a normally-open second input port connected to atmosphere; wherein said fourth valve means consists of a solenoid valve having a normally-closed input port connected to atmosphere; and wherein said first and second input ports are opened and closed, respectively, by cyclical pulses transmitted at variable frequency by said first, second and third electronic control means.

19. A carburetor kit for improving the emissions of internal-combustion engines having a carburetor wherein an air-fuel mixture is produced by drawing fuel from a fuel float chamber into an air stream flowing through a venturi tube as a result of a vacuum provided at an intake manifold, comprising:

(a) pneumatic passage means for connecting the float chamber and the intake manifold, so that a negative pressure differential is available for application to the float chamber;

(b) first valve means for controlling the flow rate through said pneumatic passage means;

(c) second valve means connected in series with said first valve means for regulating said negative pressure differential available for application to the float chamber;

(d) sensor means for measuring the oxygen content of exhaust gases of the engine and for generating a signal corresponding to said oxygen content; and (e) electronic control means for actuating said first and second valve means in response to the signal generated by said sensor means, such that a flow rate through said first and second valve means is progressively reduced as the oxygen content in the exhaust gases increases and is progressively increased as the oxygen content in the exhaust gases decreases.

20. The apparatus of claim 19, further comprising accumulator means connected between said first and second valve means for dampening an output of said second valve means.

21. The apparatus of claim 19, further comprising a bypass line connected in parallel to said venturi tube and comprising third valve means in said bypass line for regulating a flow of said air stream through the bypass line.

22. The apparatus of claim 21, further comprising second electronic control means for actuating said third valve means in response to the signal generated by said sensor means, such that a flow rate through said third valve means is progressively reduced as the oxygen content in the exhaust gases increases and is progressively increased as the oxygen content in the exhaust gases decreases.

23. The apparatus of claim 22, further comprising accumulator means connected between said first and second valve means for dampening an output of said second valve means.

24. A carburetor kit for improving the emissions of internal-combustion engines having a carburetor wherein an air-fuel mixture is produced by drawing fuel from a fuel float chamber into an air stream flowing through a venturi tube as a result of a vacuum provided at an intake manifold, comprising:

(a) pneumatic passage means for connecting the float chamber and the intake manifold, so that a negative pressure differential is available for application to the float chamber;

(b) first valve means for controlling the flow rate through said pneumatic passage means;

(c) a bypass line connected in parallel to said venturi tube and comprising second valve means in said bypass line for regulating a flow of said air stream through the bypass line;

(d) sensor means for measuring the oxygen content of exhaust gases of the engine and for generating a signal corresponding to said oxygen content; and (e) electronic control means for actuating said first valve means in response to the signal generated by said sensor means, such that a flow rate through said first valve means is progressively reduced as the oxygen content in the exhaust gases increases and is progressively increased as the oxygen content in the exhaust gases decreases; and for actuating said second valve means in response to the signal generated by said sensor means, such that a flow rate through said second valve means is progressively reduced as the oxygen content in the exhaust gases increases and is progressively increased as the oxygen content in the exhaust gases decreases.

* * * * *